US006451412B1

(12) United States Patent
Holden

(10) Patent No.: US 6,451,412 B1
(45) Date of Patent: Sep. 17, 2002

(54) FABRIC SEAM

(75) Inventor: David Holden, Blackburn (GB)

(73) Assignee: Voith Fabrics Heidenheim GmbH & Co KG, Heidenheim (DE)

( * ) Notice: Subject to any disclaimer, the term of this patent is extended or adjusted under 35 U.S.C. 154(b) by 0 days.

(21) Appl. No.: 09/463,950

(22) PCT Filed: Aug. 6, 1998

(86) PCT No.: PCT/GB98/02255

§ 371 (c)(1),
(2), (4) Date: Apr. 28, 2000

(87) PCT Pub. No.: WO99/07937

PCT Pub. Date: Feb. 18, 1999

(30) Foreign Application Priority Data

Aug. 9, 1997 (GB) ..... 9716932

(51) Int. Cl.[7] ..... B32B 23/02

(52) U.S. Cl. ..... 428/193; 428/222; 442/181; 442/203

(58) Field of Search ..... 428/193, 192, 428/222; 442/203

(56) References Cited

U.S. PATENT DOCUMENTS 5,188,884 A 2/1993 Smith ..... 428/193

5,346,590 A 9/1994 Jaala ..... 162/232

FOREIGN PATENT DOCUMENTS

| | | |
|---|---|---|
| EP | 0 012 519 | 6/1980 |
| EP | 0 557 572 | 9/1993 |
| EP | 0 577 572 | 1/1994 |
| EP | 0806519 | * 11/1997 |
| WO | 96/07789 | 3/1996 |

* cited by examiner

*Primary Examiner*—Elizabeth M. Cole
(74) *Attorney, Agent, or Firm*—Caesar, Rivise, Bernstein, Cohen & Pokotilow, Ltd.

(57) ABSTRACT

A seam construction for a woven dryer fabric comprises a helical spiral or array of loops (43) stitched or woven into the fabric by means of loop engaging yarns (42) extending the machine direction of the fabric, the neutral plane (44) of the fabric being displaced towards the paper contacting side of the fabric, by reason of yarns (41) in the paper contacting side of the fabric being of smaller diameter than the yarns (40) on the machine side of the fabric, and a pair of cross-machine yarns (44, 45) of equal diameter being located as terminal yarns adjacent the loops (43).

9 Claims, 1 Drawing Sheet

FABRIC SEAM

This application is a 371 of PCT/6898/02255 filed Aug. 6, 1998.

This invention relates to an improved fabric seam for paper making machine fabrics, and in particular to dryer fabrics for use in the dryer sections of paper machines.

In a typical dryer section, a dryer fabric carries a paper web in contact with one surface over a plurality of heated dryer rolls, with the paper web in contact with the dryer rolls surfaces, and over a plurality of unheated guide and drive rolls, with the non-paper carrying surface of the fabric in contact with the guide roll surfaces, the drying and guide rollers are typically arranged in a festoon of alternating rollers disposed in two lines, with the fabric carrying the paper web following a zig zag course about alternate drying and guide rolls.

It has been found in practice that because the paper web is on the inner face of the fabric about the drying rolls and on the outer face of the fabric about the guide/drive rolls, it has a different speed as it passes respectively about the drying rolls and the guide rolls and furthermore has a quickly alternating positive and negative speed differential with respect to the fabric and this results in friction between the paper web and the fabric. This causes a deterioration in the quality of the paper surface and an increase in wear on the paper contacting side of the fabric.

There exists a plane in the fabric which has a constant velocity throughout the path of the dryer belt through the machine. This is referred to as the neutral plane.

The position of the neutral plane has been shown to be linked to fabric symmetry and that by increasing the asymmetry of the fabric the neutral plane can be brought closer to the fabric face. It is desirable that the neutral plane should be as close as possible to the interface between the fabric and the paper web, to reduce the friction occurring between the paper and the fabric to a minimum. EP-A-0557572 discusses the theory of the neutral plane and discloses asymmetric fabric structures made of layers of differing thickness and differing modules of elasticity. Another fabric construction to displace the neutral plane is to construct the fabric from unequal yarns, e.g. weft or cross-machine direction yarns may be provided in two or more layers, with the thicker yarns forming a layer towards the non-paper carrying face of the fabric and a layer of thinner yarns being toward the paper contacting face of the fabric. The neutral plane is displaced towards the paper contacting face of the fabric in this case.

Dryer fabrics are typically joined end to end to make them endless by a spiral seam, wherein a flattened helical coil is woven or stitched into each fabric end, to extend across the width of the fabric. To join the ends, the loops of the two spirals are interdigitated and a pintle wire inserted along the tunnel thus formed. Examples of such seams are described in PCT/GB 95/02007 or co-pending Application No. 9703297.3.

Ideally, the seam will lie in the plane of the fabric, to minimise any tendency to lie proud to either side. In fabrics with a symmetrical structure (and thus a centrally disposed neutral plane) the seam will be symmetrically disposed. However, with an asymmetric structure such as suggested above wherein the neutral plane is displaced towards the paper contacting surface of the fabric, the spiral seam is displaced to tend to lie in the neutral plane. As a result the spiral seam also tends to stand proud. on the paper contacting side of the fabric face. This results in marking of the paper web and accelerated seam wear which shortens the useful life of the fabric due to earlier seam failure-or replacement when excessive wear is detected.

An object of this invention is to provide a seam for a woven dryer fabric which is arranged to be aligned below-the neutral plane, so that the seam does not stand proud of either face of the belt and marking and accelerated wear are thus avoided.

An object of the invention is to further provide a woven dryer fabric which incorporates such a seam.

According to the invention a seam construction for a woven dryer fabric comprises at each end of the fabric, a helical spiral or an array of loops, stitched or woven into the fabric by means of loop engaging yarns extending in the machine direction of the fabric, in which the neutral plane of the fabric is displaced from the central plane of the fabric towards the paper-contacting side, characterised in that, at each said end, adjacent the respective loops, at least one pair of cross-machine direction yarns are disposed, the yarns of said pair being substantially equal in diameter.

Preferably the fabric comprises at least two layers of cross-machine direction yarns, the yarns in the layer towards the paper-contacting side being lesser in diameter than at least one other of said layers.

There may of course be more than two such pairs of substantially equal yarns adjacent the loops, to establish a narrow strip of fabric which will enable the seam loops to lie in the geometric plane of the fabric rather than in the neutral plane.

Preferably the diameter of the yarns adjacent to the loops is less than the largest yarn diameter in the fabric, and greater than the smallest yarn diameter in the fabric.

There may be more than two layers of cross-machine direction yarns forming the fabric. These may comprise yarns of varying thickness towards the paper contacting face of the fabric.

In an alternative, the pair of loop adjacent yarns may be replaced by a coarse yarn, the diameter of which is greater than the largest yarn diameter in the fabric but less than the sum of yarn diameter in the yarn pair next to the loop—adjacent yarn.

The spiral used to form the seam may have a circular, flattened or other profile, preferably a rectangular cross section which helps to reduce the proudness of the spiral with respect to the paper contacting side of the fabric.

The invention has made it possible to have a raised neutral line fabric with a seam below the neutral line.

The invention will now be further described by way of example, with reference to the accompanying drawings, wherein.

Figure 1:
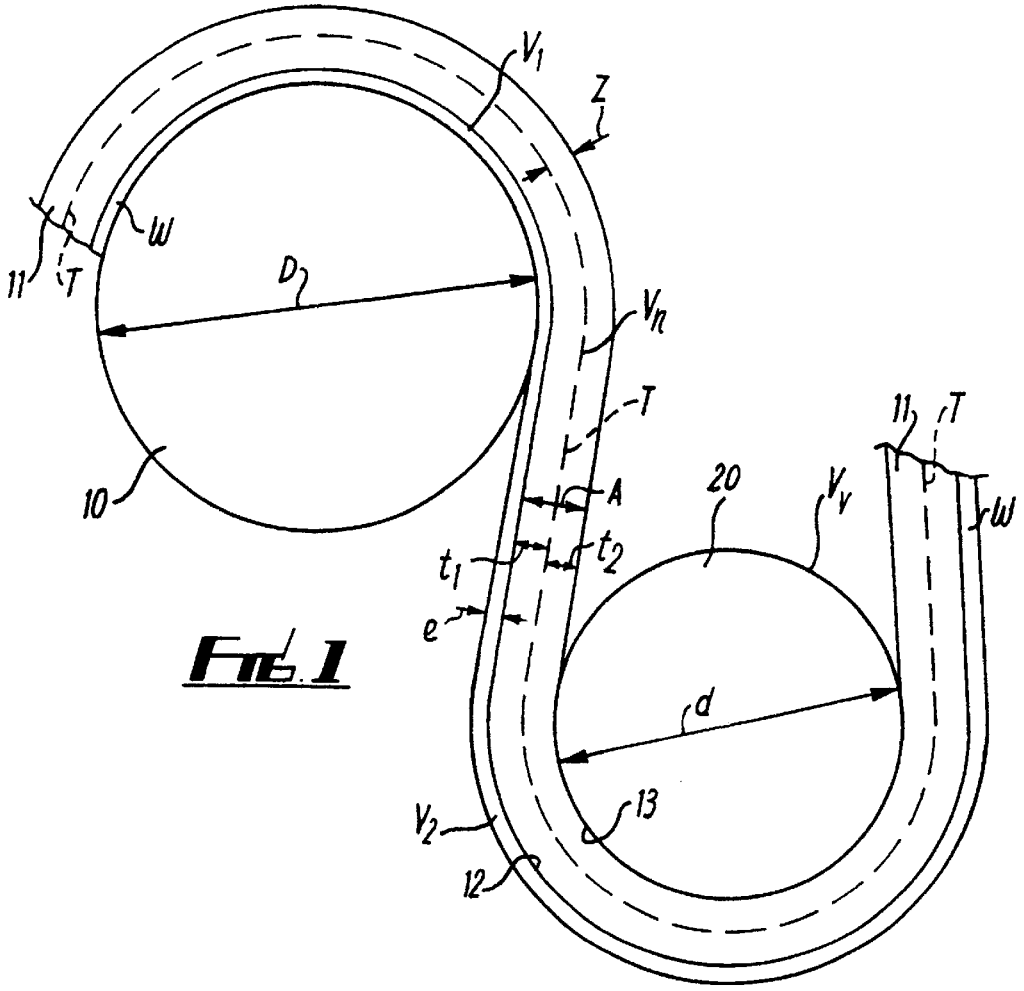
FIG. 1 is a diagram illustrating the theory of the neutral plane.

In FIG. 1 is illustrated one pair of rollers from a dryer stage, comprising a heated drying roller 10 and a drive or guide roller 20. The references in FIG. 1 are as follows:

D=diameter of drying roll 10;

d=diameter of guide roll 20;

A=thickness of dryer fabric belt 11;

e thickness of paper web, w;

N=percentage of asymmetry of drying wire;

$t_1$=distance of the neutral plane T—T during bending of the dryer fabric 11 from the paper side face 12 of the fabric 11;

$t_2$=distance of the neutral plane T—T from the face 13 of the drying wire 11 placed at the side of the mantle of the guide roll 20;

$V_1$=speed of the paper web W on the drying roll 10;

$V_2$=speed of paper web W on the guide roll 20;

$V_n$=speed of the neutral plane T—T of the dryer fabric;

$V_s$=speed of the face of cylinder 10;

$V_v$=speed of the face of roll 20; and

Z=distance of neutral plane T—T from the inner face of the fabric.

The neutral plane position in the fabric is found by:

$$V_2 - V_1 = V_n \frac{d + 2A + e}{d + 2NA} \frac{D + e}{D + 2A(1 - N) + 2e}$$

The asymmetricality N, is equal to $t_2/A$ or Z/A where $t_2$ is the distance between the constant speed plane from the paper contacting surface of the dryer fabric and Z is the distance between the constant speed plane from the opposite surface of the dryer fabric. In practice the asymmetry is normally set at 60–69% by special design of the weave structure, e.g. Scapa Scandias QUANTUM (Registered trade mark) fabric, or as described in U.S. Pat. No. 5,346,590.

Figure 2:
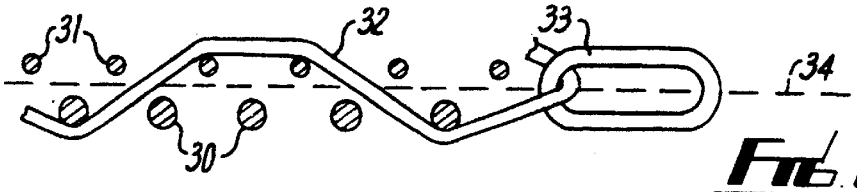
FIG. 2 (Prior Art)
FIG. 2 is a diagrammatic cross-section of a seam region of a prior art dryer fabric.

A simplified form of asymmetric fabric is shown in FIG. 2 showing how in the prior art, the asymmetry of the fabric weave results in asymmetric placement of a loop or spiral seam.

FIG. 2 is shown as comprising two layers of cross-machine direction yarns. The lower layer comprises large diameter yarns 30, and the upper paper contacting side yarns comprises small diameter yarns 31. Machine direction warp yarns are woven through the weft cross-machine direction yarns, only one of which 32 is shown by way of example. The weave pattern provides for each warp yarn to be floated over two upper layer yarns 31 and below one lower layer yarn 30 in each weave repeat. The machine direction yarn 32 is passed about a loop 33 which is part of a spiral seam.

The neutral plane 34 (shown as a broken line) is by reason of the asymmetric construction of the fabric displaced towards the top, paper contacting side and as -a result of the asymmetric weave, the loops 33 of the spiral seam are displaced upwardly to be centred on the neutral plane 34. This prior art construction is unsatisfactory so far as the seam is concerned, because the seam tends to lie proud of the fabric on the paper side, which promotes marking of the paper web.

Figure 3:
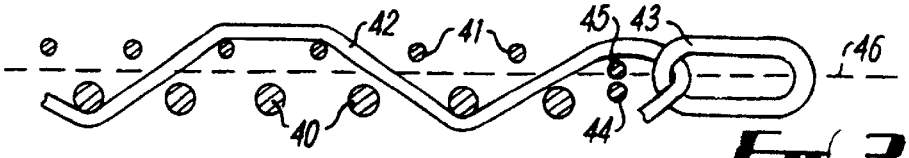
FIG. 3 is a similar cross-section of a dryer fabric incorporating a seam construction according to the present invention.

In accordance with the invention, FIG. 3 illustrates in a diagram similar to FIG. 2, a solution to this problem. The fabric as before comprises a lower layer of large diameter cross-machine direction weft yarns 40 and an upper layer of small diameter weft yarns 41. Warp yarns 42 in the machine direction are woven into the weft in the same way as in FIG. 2. However, adjacent the seam loops 43 a pair of cross-machine direction yarns 44,45 are disposed, one above the other. The yarns 44,45 are of a diameter intermediate the diameters of the large yarns 40 and the small yarns 41 and are equal in diameter to each other. They are disposed symmetrically with respect not to the neutral plane 46, but to the geometrical centre plane of the fabric. This arrangement of these additional yarns adjacent the loops has the effect of enabling the loops 43 of the seam to lie symmetrically with the geometric centre plane of the fabric and not with the neutral plane, so that the seam is not biassed to one face of the fabric, and thus protrudes minimally beyond or is flush with both surfaces of the fabric equally.

Figure 4:
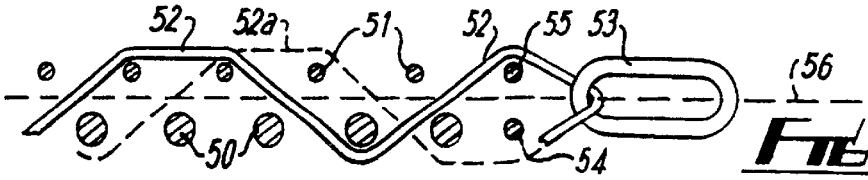
FIG. 4 is a similar cross section of a further embodiment of the invention.

FIG. 4 shows a further embodiment of a similar fabric with a lower layer of large diameter cross-machine direction weft yarns 50 and an upper layer of small diameter weft yarns 51. Warp yarns 52 in the machine direction are woven into the weft in the same way as in the preceding embodiments. However, the warp yarn is looped about the upper yarn 55 of a pair of cross-machine direction yarns 54, 55 disposed one above the other at the edge of the fabric adjacent the seaming loop or spiral 53. The end of the yarn 52 is woven back as shown by a broken line 52*a*. The neutral plane is shown by broken line 56. Alternate yarns 52 are looped about the upper and lower yarns of the pair 54, 55 and other yarns in each weave repeat looped about the seaming spiral loops 53, as in FIG. 3.

This clearly minimises marking of the paper web by the seam.

More than one pair of additional yarns may be provided to form a narrow marginal strip for seating the seam loops symmetrically in the fabric.

What is claimed is:

1. A seam construction for a woven dryer fabric for a paper machine comprising at each end of the fabric, a helical spiral or an array of loops which can be interdigitated to enable a pintle wire to be passed through the interdigitated loops, and are stitched or woven into the fabric by loop engaging yarns extending in the machine direction of the fabric in which a neutral plane of the fabric is displaced from a central plane of the fabric towards a paper contacting side of the fabric, wherein at each end of said fabric adjacent the respective spiral or loops, at least one pair of cross-machine direction yarns is disposed, the yarns of said pair being substantially equal in diameter which will enable the seam spirals or loops to lie in the geometric plane of the fabric rather than in the neutral plane.

2. A seam construction according to claim 1, wherein the fabric comprises at least two layers of cross-machine direction yarns, the yarns in the layer towards the paper contacting side being lesser in diameter that at least one of the said other layers.

3. A seam construction according to claim 1, where there are two or more pairs of substantially equal yarns,adjacent the loops.

4. A seam construction according to claim 1, wherein the diameter of the said yarns of said pair or pairs is less than the largest yarn diameter in the fabric, and greater than the smallest yarn diameter in the fabric.

5. A seam construction according to claim 2, wherein there are more than two layers of cross-machine direction yarns in the fabric.

6. A seam construction according to claim 5, wherein the yarns in said layers of cross-machine direction yarns reduce in diameter towards the paper contacting face of the fabric.

7. A seam construction according to claim 1, wherein the yarn forming the spirals or loops is of a square, rectangular or flattened cross-section.

8. A seam construction according to claim 1, characterised in that one or more pairs of yarns between the normal weave of the fabric and the seam loops are replaced by a single large diameter yarn, having a diameter greater than the largest yarn diameters in the fabric, but less than the sum of the yarn diameter of the yarn pair of the normal weave closest to the loops.

9. A seam construction in a woven papermachine dryer fabric, comprising, at each end of said fabric:

a helical spiral or an array of interdigitable loops arranged to enable a pintle wire to be passed through said loops when interdigitated;

said spiral or array of loops arranged to be stitched or woven into the fabric by loop engaging yarns extending in a machine direction of the fabric, the fabric having a neutral plane which is displaced from a central plane of the fabric towards a paper contacting side thereof; and each fabric end having disposed thereat, adjacent said spiral or said loops, at least one pair of cross machine direction yarns, said yarns being of substantially equal diameter and disposed symmetrically with respect to said central plane to thereby allow the seam spirals or loops to lie in said central plane of the fabric instead of in said neutral plane.

* * * * *